US006150908A

United States Patent [19]

Asakawa et al.

[11] Patent Number: 6,150,908

[45] Date of Patent: Nov. 21, 2000

[54] CIRCUIT BREAKER WITH METAL MELT ISOLATION DEVICE

[75] Inventors: Koji Asakawa; Naoshi Uchida; Mitsuyoshi Yamazaki; Jun Oyama; Kentaro Toyama, all of Saitama, Japan

[73] Assignee: Fuji Electric Co., Ltd., Kawasaki, Japan

[21] Appl. No.: 09/379,794

[22] Filed: Aug. 24, 1999

[30] Foreign Application Priority Data

Sep. 3, 1998 [JP] Japan ..... 10-249340

[51] Int. Cl.[7] ..... H01H 67/02

[52] U.S. Cl. ..... 335/132; 335/202; 218/156

[58] Field of Search ..... 335/132, 202, 335/8–10; 200/295–308; 218/156

[56] References Cited

U.S. PATENT DOCUMENTS 4,644,308 2/1987 Guery et al. ..... 335/128
4,973,929 11/1990 Duchemin ..... 335/132
5,276,417 1/1994 Blanchard et al. ..... 335/132
5,546,062 8/1996 Duchemin ..... 335/132

*Primary Examiner*—Lincoln Donovan
*Assistant Examiner*—Tuyen T. Nguyen
*Attorney, Agent, or Firm*—Kanesaka & Takeuchi

[57] ABSTRACT

An insulated container of a circuit breaker is divided into three vertically-arranged portions including a case, a middle case, and a cover. A fixed contact shoe and a movable contact shoe are accommodated in the case. An opening and closing mechanism and an overcurrent trip device are accommodated in the middle case. A holder slidably passing through a hole in a bottom wall of the middle case by an operation of the opening and closing mechanism is moved linearly and perpendicularly to the bottom wall to open and close the movable contact shoe. A gap in the hole between the holder and the bottom wall is very small due to the straight movement of the holder, so that an arc gas generated in the case is completely shut down by the bottom wall and does not reach the opening and closing mechanism in the middle case during current interruption.

10 Claims, 7 Drawing Sheets

CIRCUIT BREAKER WITH METAL MELT ISOLATION DEVICE

BACKGROUND OF THE INVENTION AND RELATED ART STATEMENT

The present invention relates to a low-voltage circuit breaker, such as a molded case circuit breaker or an earth leakage breaker, and in particular, to an improvement for preventing metal melt generated during current interruption from spreading to an opening and closing mechanism.

In a circuit breaker, power-supply-side and load-side terminals are generally placed at respective longitudinal ends of a box-shaped insulated container, and the insulated container accommodates a conductor forming an electric path joining the terminals together; movable and fixed contact shoes that open and close the electric path; an arc-extinguishing chamber surrounding the movable contact shoe; an opening and closing mechanism for opening and closing the movable contact shoe via a holder made of an insulating material; and an overcurrent trip device for tripping the opening and closing mechanism.

FIG. 10 is a vertical sectional view showing an example of a conventional circuit breaker, i.e. three-pole circuit breaker, in its ON state, and FIGS. 11(A) and 11(B) are enlarged front views taken along line 11A,B—11A,B in FIG. 10, wherein FIG. 11(A) is an ON state and FIG. 11(B) is an OFF state.

In FIG. 10, a power-supply-side terminal 3 and a load-side terminal 4 for each pole are placed at the longitudinal (lateral direction in FIG. 10) ends of a box-shaped insulated container, which is formed of a case 1 with its top surface open and a cover 2 with its bottom surface open. An electric path between the terminals includes a fixed contact shoe 5 integrated with the power-supply-side terminal 3, a movable contact shoe 6 with one end contacting the fixed contact shoe 5, a lead wire 7 connected to the other end of the movable contact shoe 6, a heater conductor 9 in an overcurrent trip device 8 connected to the lead wire 7, and a relay conductor 10 connected to the heater conductor 9 and integrated with the load-side terminal 4. Fixed contact 5*a* and movable contact 6*a* are attached to the contact ends of the fixed and movable contact shoes 5, 6, respectively.

The movable contact shoe 6 is held at the right end in FIG. 10 in a cantilever manner by means of a holder 11 made of an insulating material, and the holder 11 is rotatably supported on the case 1 via an opening and closing shaft 12 that integrally connects the holders 11 for the respective poles. An opening and closing mechanism 13 is connected to the holder 11 for the central pole, and a switching handle 14 protruding from the cover 2 is moved to the right or left direction of FIG. 10 for an opening and closing operation to rotationally move the movable contact shoe 6 via the holder 11 so as to open and close in the direction shown by the arrow in the figure. In addition, when an overcurrent is generated, the overcurrent trip device 8 is activated to unlatch the opening and closing mechanism 13 via a trip cross bar 15 in order to automatically open the movable contact shoe 6. When the movable contact shoe 6 is opened, an arc occurs between the movable and fixed contacts 6*a* and 5*a*. To extinguish this arc, an arc-extinguishing chamber 16 is installed so as to surround the movable shoe 6.

The arc-extinguishing chamber 16 is composed of a plurality of magnetic plates or grids 17, each having a V-shaped notch and supported on a support plate 18 made of an insulating material. The arc-extinguishing chamber 16 withdraws the arc into the grids 17, where it is separated and cooled for extinction. The overcurrent trip device 8 in FIG. 10 is electromagnetically or thermally driven in a well-known manner. In an overcurrent condition, a bimetal in the overcurrent trip device 8 bends to rotationally move the trip cross bar 15, while in a high current condition including a short-circuit current, the device 8 instantaneously attracts a movable iron core to rotationally move the trip cross bar 15.

In the above circuit breaker, during the current interruption, arc heat melts the metal parts exposed to the arc, for example, the contacts 5*a*, 6*a*, the movable contact shoe 6 and the grids 17, and the metal melt splashes therearound due to a gas pressure generated by the arc heat.

Thus, a bulkhead or separating wall 19 formed of an insulated plate is conventionally inserted between the arc-extinguishing chamber 16 and the opening and closing mechanism 13 to prevent the metal melt from entering the opening and closing mechanism 13. When the metal melt adheres to the opening and closing mechanism 13, its movable part may be hindered from movement and even the opening and closing operations may be disabled.

As shown in FIGS. 11(A) and 11(B), the bulkhead or separating wall 19 is shaped like a gate having a slit 20 in the moving direction of the movable contact shoe 6, and is installed to separate an electric-path space for each of the poles partitioned and formed in the case 1 and cover 2 by means of inter-phase bulkheads. FIG. 11(A) shows an OFF state and FIG. 11(B) shows an ON state. As seen in FIG. 11(A), during the OFF state, the slit 20 forms a gap shown by shading in the lower part of the movable contact shoe 6, whereas during the ON state as shown in FIG. 11(B), the slit 20 forms a gap in the upper part of the movable contact shoe 6. Thus, conventionally, the bulkhead 19 can not sufficiently preclude the metal melt from entering the opening and closing mechanism 13, so that the opening and closing mechanism 13 has often been hindered from normal operations.

An object of this invention is to provide a circuit breaker that prevents metal melt generated by arc heat from entering the opening and closing mechanism.

SUMMARY OF THE INVENTION

To achieve this object, the invention provides in a first aspect a circuit breaker, wherein an insulated container comprises three vertically-arranged portions including a case with its top surface open, a middle case forming a frame with a bottom wall, and a cover with its bottom surface open. A movable contact shoe is adapted to open and close when a holder moves linearly and perpendicularly to the bottom wall of the middle case. The movable and fixed contact shoes and an arc-extinguishing chamber are accommodated in the case while the opening and closing mechanism and the overcurrent trip device are accommodated in the middle case. The holder is placed so as to slidably penetrate through the bottom wall of the middle case. According to the first aspect of the invention, an opening and closing mechanism and an overcurrent trip device, each of which has a movable part, are separated by the bottom wall of the middle case from the movable and fixed contact shoes and arc-extinguishing chamber that may generate metal melt, and the holder of the movable contact shoe moves linearly and perpendicularly to the bottom wall of the middle case. This configuration can minimize the gap between the holder and a hole in the bottom wall of the middle case through which the holder slidably penetrates, thereby preventing metal melt from entering into the opening and closing mechanism.

In the circuit breaker according to the first aspect, the middle case is divided into a power-supply-side middle case and a load-side middle case, so that the opening and closing mechanism is accommodated in the power-supply-side middle case while the overcurrent trip device is accommodated in the load-side middle case (second aspect). Thus, units for different functions can be made, wherein the power-supply side includes the opening and closing mechanism section and the load side includes an overcurrent trip device section. Since the opening and closing mechanism and the overcurrent trip device are formed of different parts depending on the interruption capacity and the rated current, respectively, different units may be prepared in which the opening and closing mechanisms and overcurrent trip devices with different types are formed integrally with divided middle cases, and these units can be arbitrarily combined to meet various specifications. Therefore, this configuration enables efficient assembly.

Furthermore, in the circuit breaker according to the second aspect, the load-side middle case may be divided so as to correspond to each polarity (third aspect). For example, if a delivery inspection discovers a flaw in the overcurrent trip device for one pole, only that pole can be replaced, thereby further improving assembly workability.

For a circuit breaker according to the first aspect, if in addition to the movable contact shoe, a contact spring for applying contact pressure between a movable contact of the movable contact shoe and a fixed contact of the fixed contact shoe is held by the holder, then this configuration will prevent the contact spring from being deformed when the opening and closing mechanism opens the movable contact shoe, thereby reducing the load on the opening and closing mechanism and thus the size of this mechanism (fourth aspect).

Furthermore, the configuration can be designed so that the opening and closing mechanism can draw the holder up from the case toward the middle case to effect the contact pressure (fifth aspect). Alternatively, the opening and closing mechanism can push the holder down from the middle case toward the case to effect the contact pressure (sixth aspect).

DETAILED DESCRIPTION OF PREFERRED EMBODIMENTS

Figure 1:
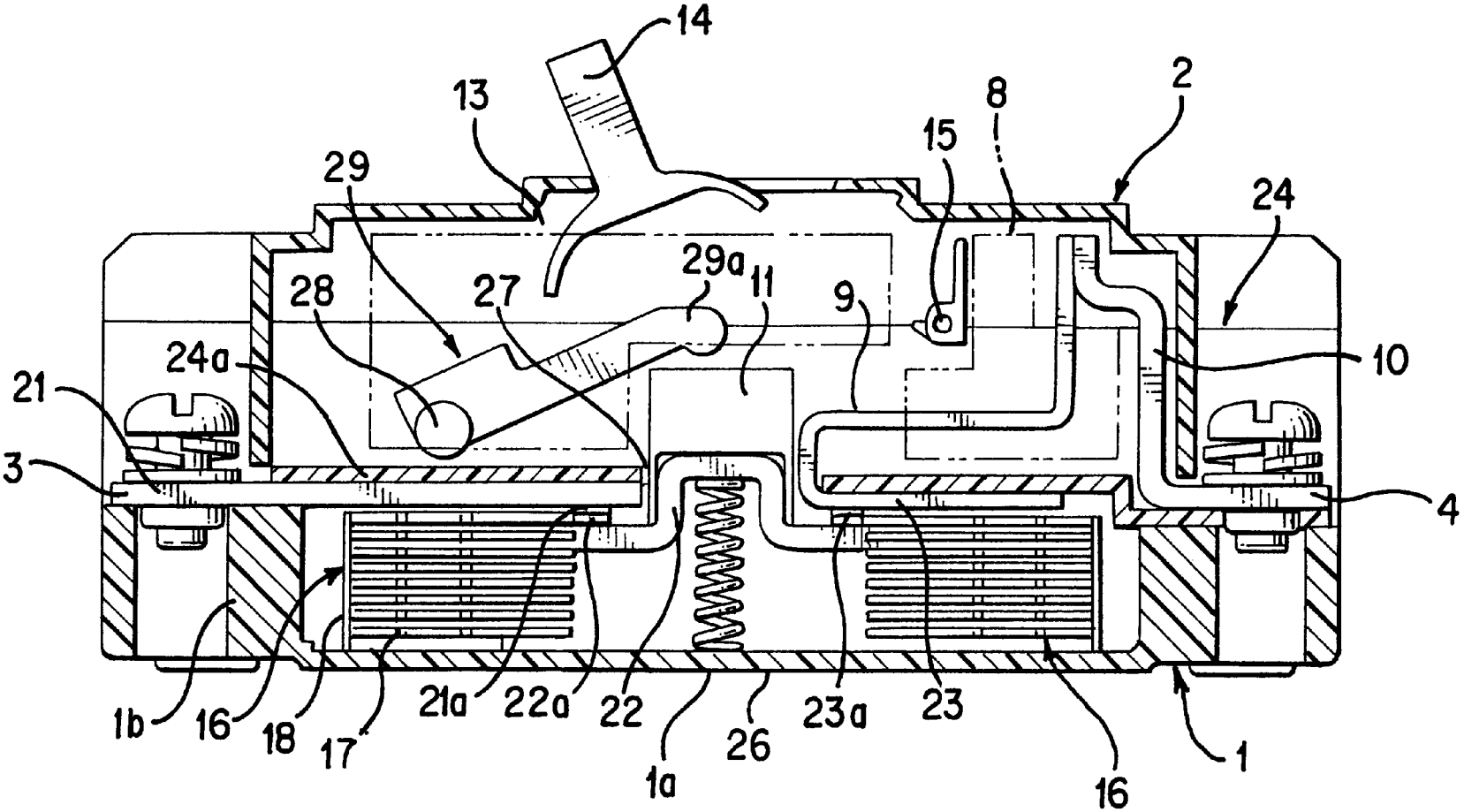
FIG. 1 is a vertical sectional view of a circuit breaker showing an embodiment of this invention.
Figure 2:
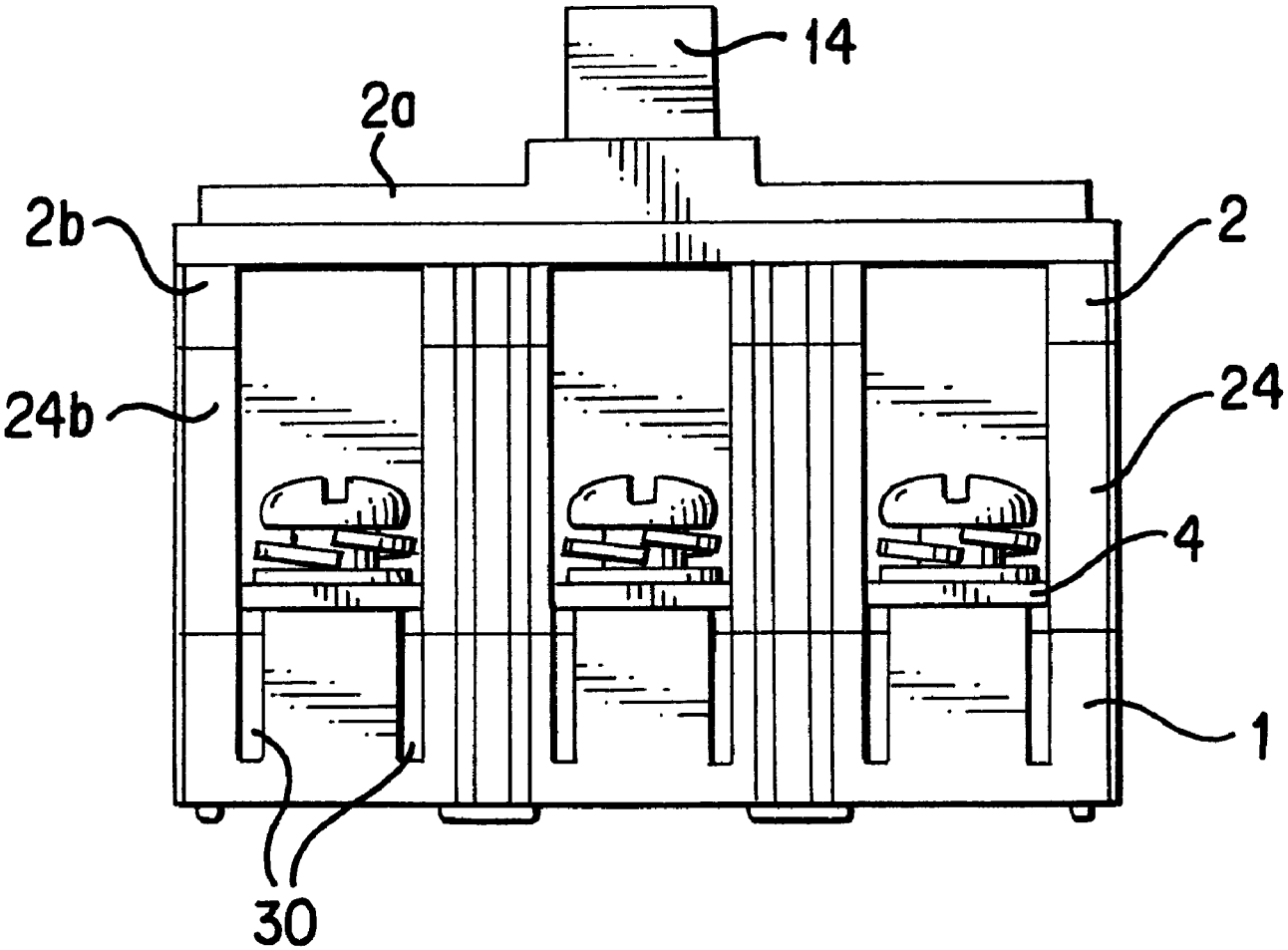
FIG. 2 is a front view of the circuit breaker shown in FIG. 1.
Figure 3:
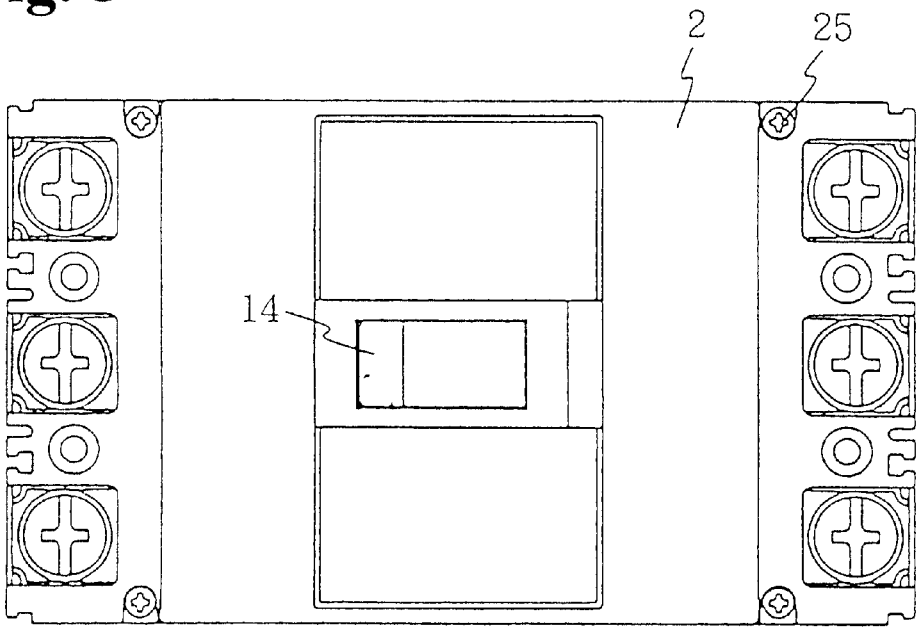
FIG. 3 is a plan view of the circuit breaker shown in FIG. 1.
Figure 4:
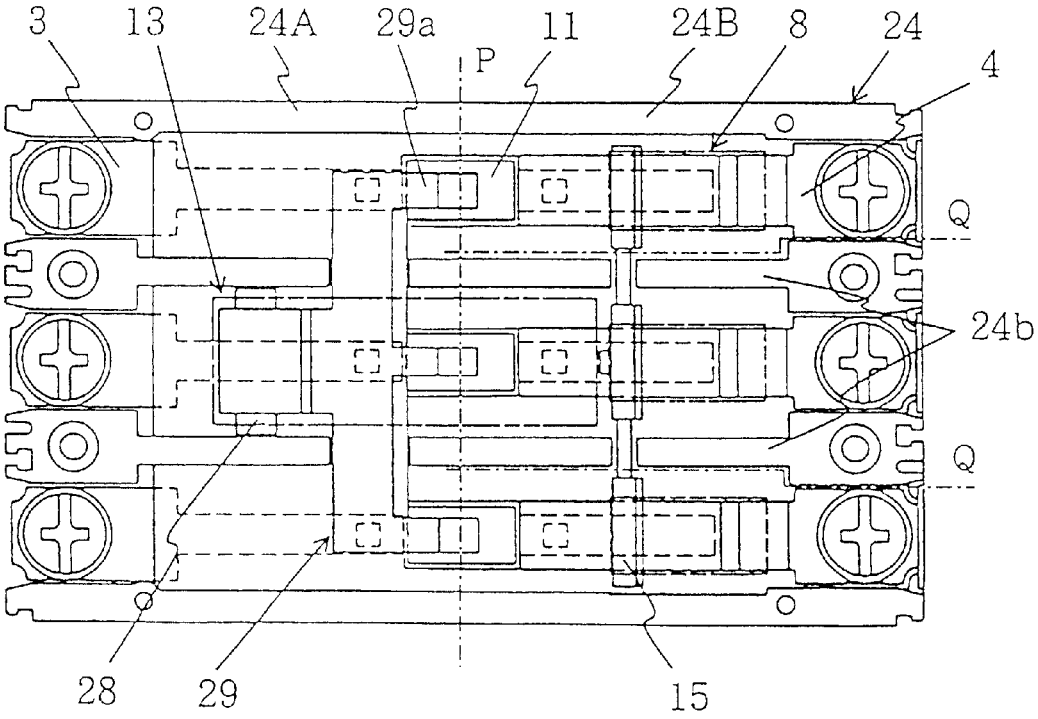
FIG. 4 is a plan view of the circuit breaker, wherein a cover shown in FIG. 3 is removed.
Figure 5:
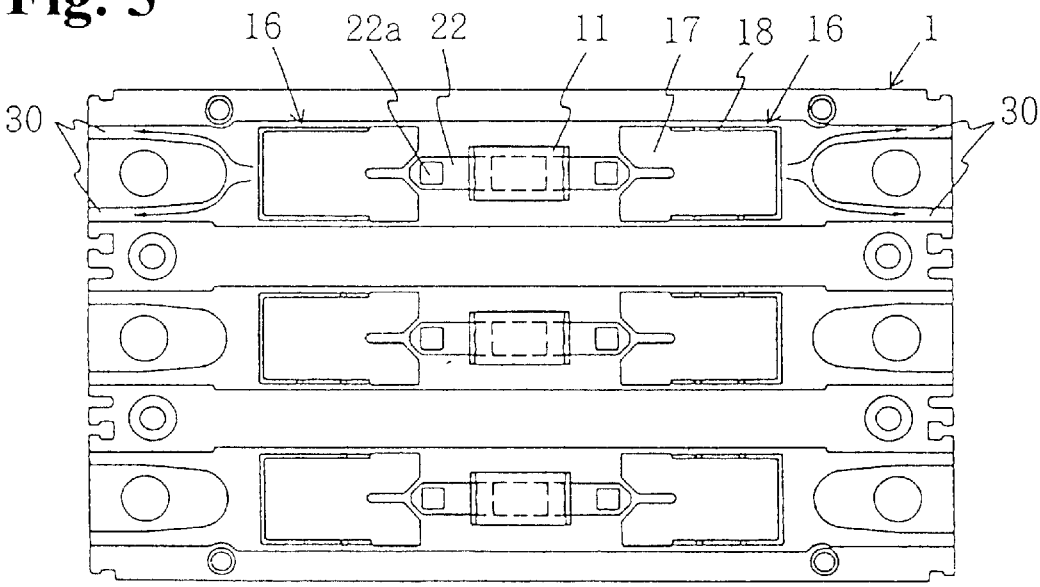
FIG. 5 is a plan view of the circuit breaker, wherein a middle case shown in FIG. 4 is removed.

An embodiment of this invention will be described with reference to FIGS. 1 to 5. FIG. 1 is a vertical sectional view of a circuit breaker in its ON state. FIG. 2 is a front view of a load side of the circuit breaker in FIG. 1. FIG. 3 is a plan view of FIG. 1. FIG. 4 is a plan view showing a middle case, wherein a cover is removed from FIG. 3. FIG. 5 is a plan view showing a case, wherein a middle case is removed from FIG. 4. Components corresponding to the conventional example have the same reference numerals.

In FIGS. 1 to 5, particularly in FIG. 1, power-supply-side and load-side terminals 3, 4 for the respective poles are placed at the longitudinal (lateral direction in FIG. 1) ends of a box-shaped insulated container. An electric path between the terminals includes one fixed contact shoe 21 integrated with the power-supply-side terminal 3, a bridge type movable contact shoe 22 with one end contacting the fixed contact shoe 21, the other fixed contact shoe 23 contacting the other end of the movable contact shoe 22, a heater conductor 9 in an overcurrent trip device 8 integrated with the fixed contact shoe 23, and a relay conductor 10 connected to the heater conductor 9 and integrated with the load-side terminal 4. Fixed contacts 21*a* and 23*a* are attached to contact ends of the fixed contact shoes 21 and 23, respectively. Movable contacts 22*a* are attached to contact portions at the respective ends of the movable contact shoe 22.

The insulated container of the circuit breaker is composed of three vertically arranged portions including a case or lower case 1 having, a lower wall 1*a*, a lower side wall 1*b* and an open top surface, a middle case 24 forming a frame having a bottom wall 24*a* and a middle side wall 24*b*, and a cover 2 having a top wall 2*a*, a cover side wall 2*b* and an open bottom surface. These portions are laminated as shown in FIG. 1 and are integrally tightened by screws 25 (FIG. 3) at four positions. The insides of the case 1, middle case 24 and cover 2 are respectively partitioned into electric-path spaces for three poles by means of two lateral rows of inter-phase bulkheads or partition walls. The case 1 accommodates a pair of arc-extinguishing chambers 16 surrounding a pair of fixed contact shoes 21, 23 for each pole disposed in the longitudinal direction, the movable contact shoe 22 for bridging the fixed contact shoes 21, 23, and the respective longitudinal ends of the movable contact shoe 22. The middle case 24 accommodates an opening and closing mechanism 13 and the overcurrent trip device 8.

The movable contact shoe 22 is folded to form a projection symmetrical in the longitudinal direction and is pressed against the fixed contact shoes 21, 23 by means of a contact spring 26 formed of a compression coil spring inserted between the movable contact shoe 22 and the bottom wall of the case 1. A rectangular columnar holder 11 formed of an insulating material is fitted on the head of the movable contact shoe 22 via a recessed portion at its lower end. The holder 11 is guided by a guide groove (not shown) formed in the case 1 so as to move linearly in the vertical direction of FIG. 1.

On the other hand, a square or through hole 27 along the contour of the holder 11 is formed in a bottom wall 24*a* of the middle case 24 so as to correspond to the holder 11. The holder 11 slidably penetrates through the hole 27 in such a way that its upper end protrudes into the middle case 24. The fixed contact shoes 21, 23 are tightened to the bottom surface of the bottom wall 24*a* of the middle case by means of screws (not shown), but are located inside the case 1 when the middle case 24 is laminated on the case 1 as shown in FIG. 1. In addition, the heater conductor 9 integrated with the fixed contact shoe 23 extends into the middle case 24 through the square hole 27.

Although the internal mechanism is not illustrated, the opening and closing mechanism 13 has a switching lever 29 that rotationally moves around a shaft 28 in the direction of the arrow shown in the figure, according to the opening and closing operation in the lateral direction of the switching handle 14 in FIG. 1. The switching lever 29 is divided into three branches formed of three arms 29*a* as shown in FIG. 4, and the tip of each arm 29*a* is located close to the upper end surface of the holder 11 for each pole during the ON state as shown in FIGS. 1 and 4. When the switching handle 14 is moved to the right in FIG. 1 for an OFF operation, the switching lever 29 is rotationally moved clockwise to press the holder 11 linearly and perpendicularly to the bottom wall 24*a* of the middle case 24 against the force of the contact spring 26. This operation opens the movable contact shoe 22 to cause the circuit breaker to become an OFF state.

When the switching handle 14 is then moved to the left of FIG. 1, the switching lever 29 returns to the illustrated position and the movable contact shoe 22 is pressed up and closed by the contact spring 26. In this case, the holder 11 elevates linearly and perpendicularly to the bottom wall 24*a* of the middle case. In addition, when an overcurrent occurs and the overcurrent trip device 8 is activated to unlatch the opening and closing mechanism 13 via a trip cross bar 15, the switching lever 29 is rotationally driven clockwise to automatically open the movable contact shoe 22. The overcurrent trip device 8 is similar to the conventional example, and the illustration of the mechanism is omitted. Since the holder 11 moves linearly and perpendicularly to the bottom wall 24*a* of the middle case 24 as described above, the gap in the square hole 27 between the holder 11 and the bottom wall 24*a* of the middle case 24 is made in a minimum size required to slide the holder 11.

In FIG. 1, when the movable contact shoe 22 is opened, arc occurs between the movable and fixed contacts 22*a*, 21*a*, 23*a*, and is withdrawn into the arc-extinguishing chambers 16, where it is extinguished. In addition, an arc gas containing metal melt generated is discharged from a pair of exhaust ports 30 formed in the front and rear portions of the case 1 as shown in FIGS. 2 and 5. The direction of the discharge is shown by the arrows in FIG. 5. In this case, most of the arc gas generated in the case 1 does not enter the inside of the middle case 24 because the gap around the holder 11 at the bottom wall 24*a* is very small.

In FIG. 4, the middle case 24 is divided into a power-supply-side middle case 24A and a load-side middle case 24B by a parting line P passing through the center of the square hole 27. The opening and closing mechanism 13 is mounted in the power-supply-side middle case 24A, and the overcurrent trip device 8 is mounted in the load-side middle case 24B. Furthermore, the load-side middle case 24B is divided by two lateral parting lines Q extending along the inter-phase bulkheads 24*b* so as to correspond to the respective poles. Each of the divided pieces is a unit including the power-supply-side middle case 24A with the opening and closing mechanism 13 fixed thereto, and the load-side middle case 24B with the overcurrent trip device 8 for each pole fixed thereto.

Figure 10:
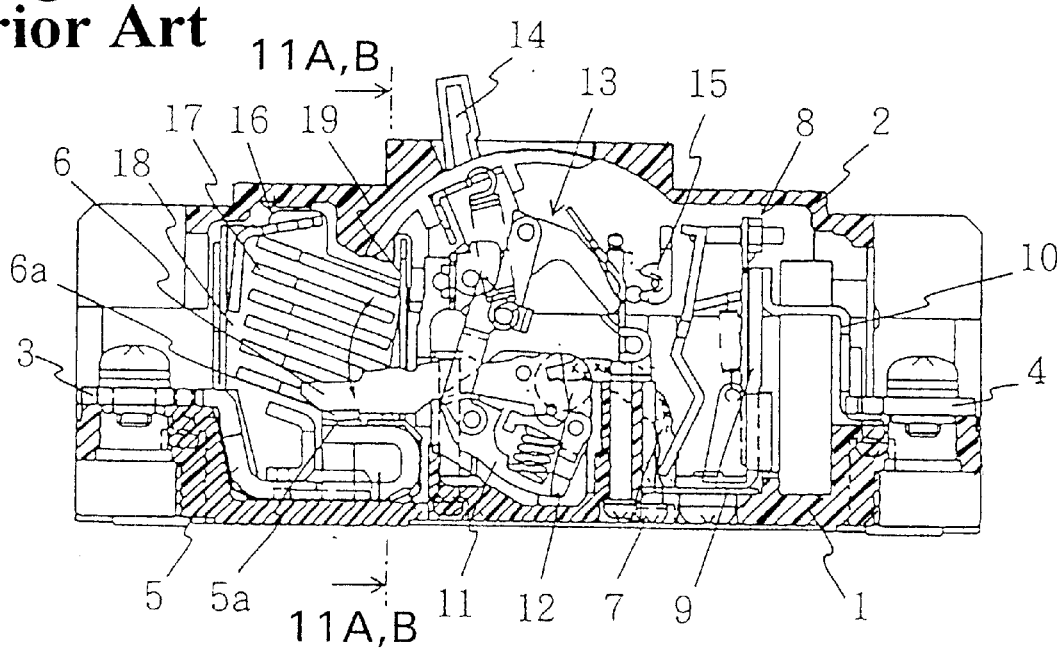
Fig. 10 Prior Art
FIG. 10 is a vertical sectional view of a circuit breaker showing a conventional example.
Figure 11A:
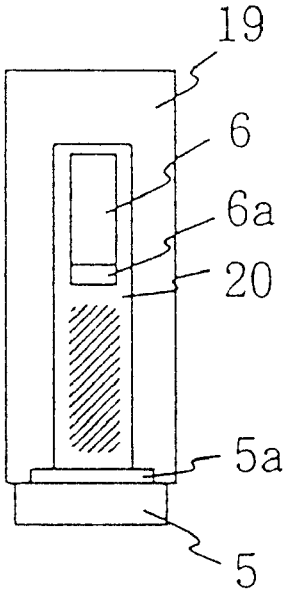
Fig. 11(A) Prior Art
FIGS. 11(A) and 11(B) are enlarged sectional views taken along line 11A,B—11A,B in FIG. 10.
Figure 11B:
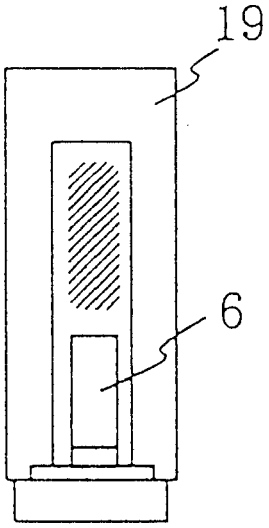
Fig. 11(B) Prior Art

As shown in FIG. 4, the middle case 24 is divided into units while preparing units for the opening and closing mechanisms 13 and the overcurrent trip devices 8 installed thereon. Also, the opening and closing mechanisms 13 with different parts depending on the interruption capacity and the overcurrent trip devices 8 with different parts depending on the rated current are prepared as units. These units can be arbitrarily combined together to obtain a circuit breaker of a desired specification. If, for example, a flaw in the overcurrent trip device 8 for either pole is found, it can be conveniently dealt with by simply replacing the corresponding part. Although the above embodiment has been shown in conjunction with the movable contact shoe in the bridging type, this invention is applicable to a rotationally-moving type movable contact shoe such as that shown in the conventional example in FIG. 10, as long as a linearly moving insulator can be used to press and rotationally move the movable contact shoe.

For the circuit breaker in FIG. 1 as described above, when an overcurrent is generated, the overcurrent trip device 8 is operated to unlatch the opening and closing mechanism 13 via the trip cross bar 15 in order to rotationally drive the switching lever 29 clockwise using an energy stored in a main spring (not shown), thereby opening the movable contact shoe 22. In this situation, the contact spring 26 supported by the case 1 is compressed and deformed throughout the opening distance traveled by the movable contact shoe 22 to apply a spring resistance to the opening and closing mechanism 13 via the movable contact shoe 22. Consequently, the load on the opening and closing mechanism 13 increases, thereby restricting the opening distance of the movable contact shoe 22.

Figure 6:
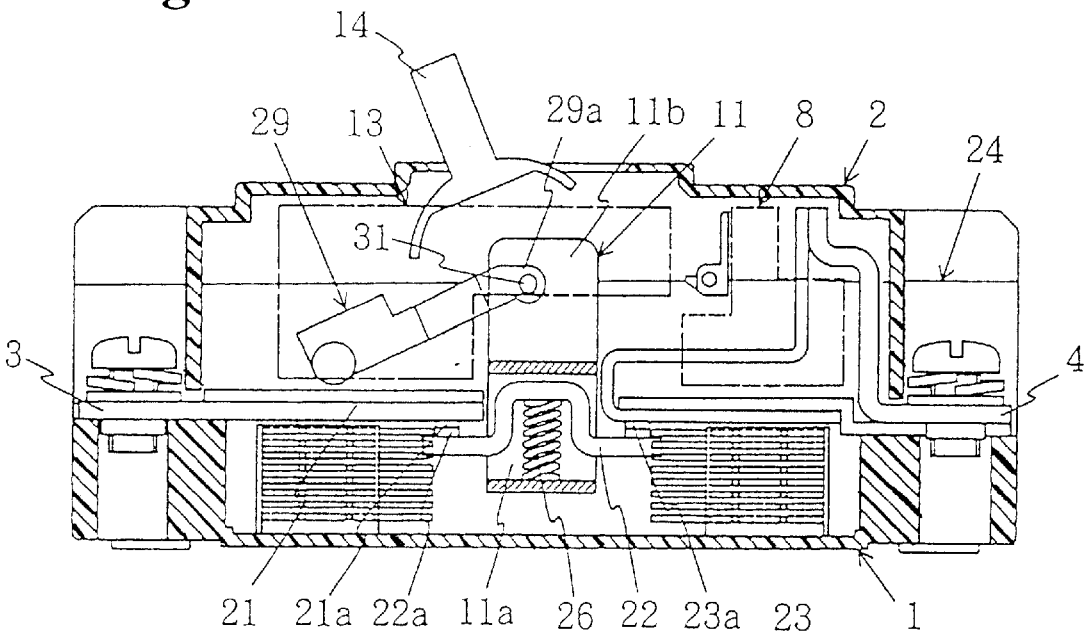
FIG. 6 is a vertical sectional view of a circuit breaker showing a different embodiment of this invention.
Figure 7:
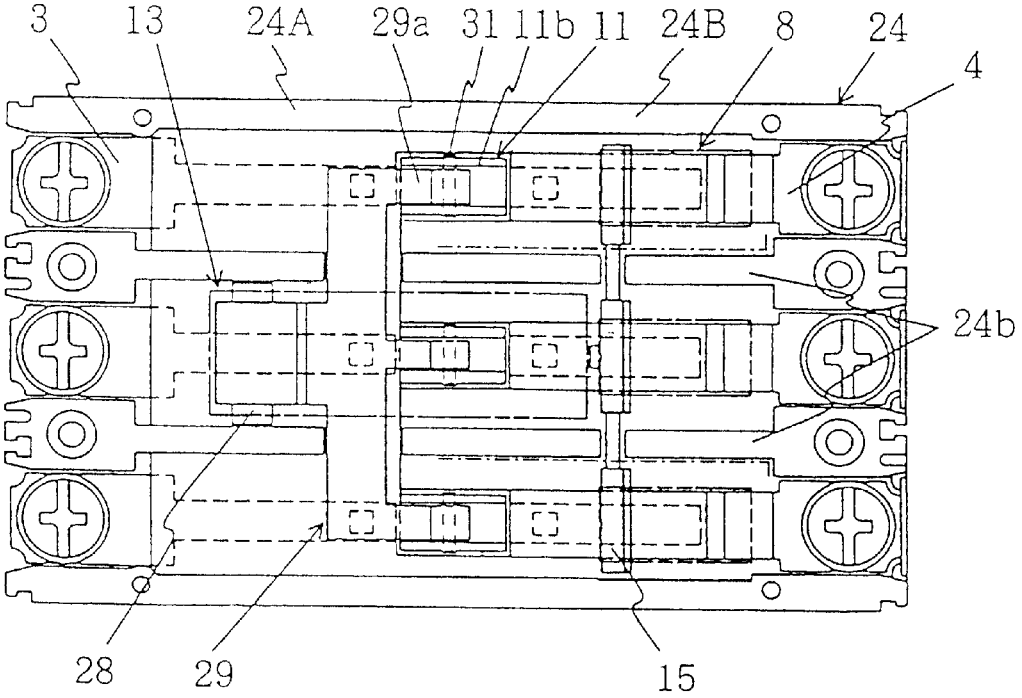
FIG. 7 is a plan view-of the circuit breaker, wherein a cover shown in FIG. 6 is removed.

FIGS. 6 and 7 show an improved embodiment of the aforementioned circuit breaker. FIG. 6 is a vertical sectional view showing the circuit breaker in its ON state, and FIG. 7 is a plan view in which the cover shown in FIG. 6 is removed to reveal the middle case. In FIGS. 6 and 7, a contact spring 26 is held by the holder 11 together with the movable contact shoe 22. The holder 11 for each pole has a window hole 11*a* that penetrates the holder in the longitudinal direction (lateral direction in FIG. 6), and the movable contact shoe 22 is housed in the window hole 11*a* to allow a vertical movement. The contact spring 26 formed of a compression coil spring is interposed between the bottom surface of the window hole 11*a* and the movable contact shoe 22 in a condition such that the spring 26 is slightly compressed and deformed.

A pair of connecting pieces 11*b* laterally spaced apart from each other is integrally formed at the head of the holder 11 in such a way as to extend in the vertical direction. An arm 29*a* of a switching lever 29 inserted between the connecting pieces 11*b* and the holder 11 is rotationally connected together via a pin 31. In the ON state shown in FIG. 6, the switching lever 29 presses the movable contact shoe 22 against the fixed contact shoes 21 and 23 while slightly compressing and deforming the contact spring 26, thereby effecting a predetermined contact pressure between the fixed contacts 21*a* and 23*a* and the movable contacts 22*a*.

For the circuit breaker shown in FIG. 6, when an overcurrent is generated, the switching lever 29 is rotationally driven clockwise to open the movable contact shoe 22. In this situation, the contact spring 26 moves integrally with the movable contact shoe 22 while being held by the holder 11, thereby preventing the contact spring 26 from being compressed and deformed as happened in the circuit breaker in FIG. 1. This configuration can reduce the load on the opening and closing mechanism 13 and thus the size of this mechanism, and it can increase the opening speed of the movable contact shoe 22.

Figure 8:
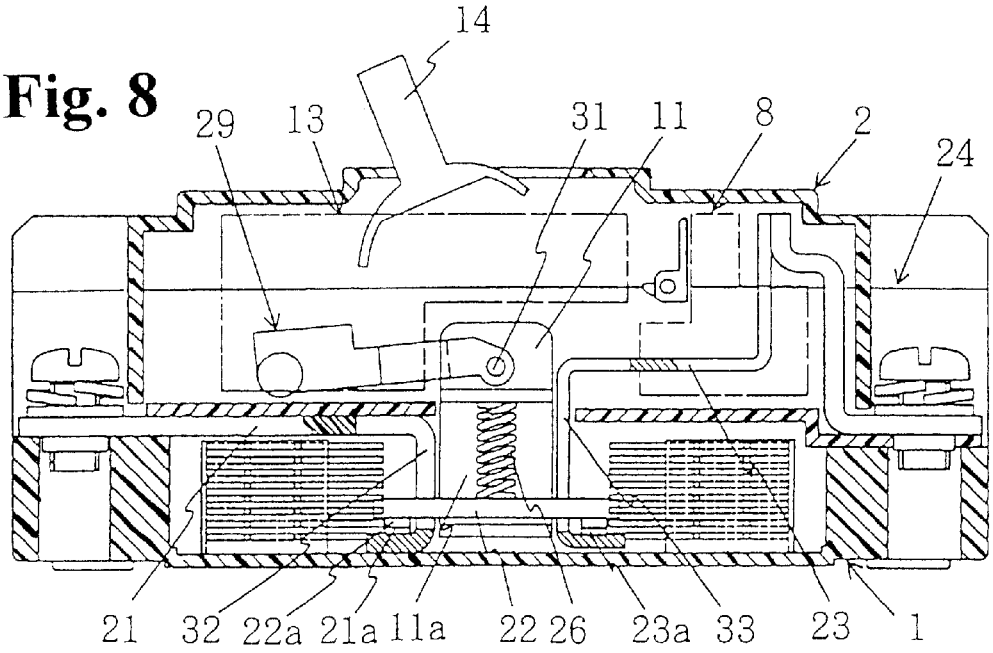
FIG. 8 is a vertical sectional view of a circuit breaker showing another different embodiment of this invention.
Figure 9:
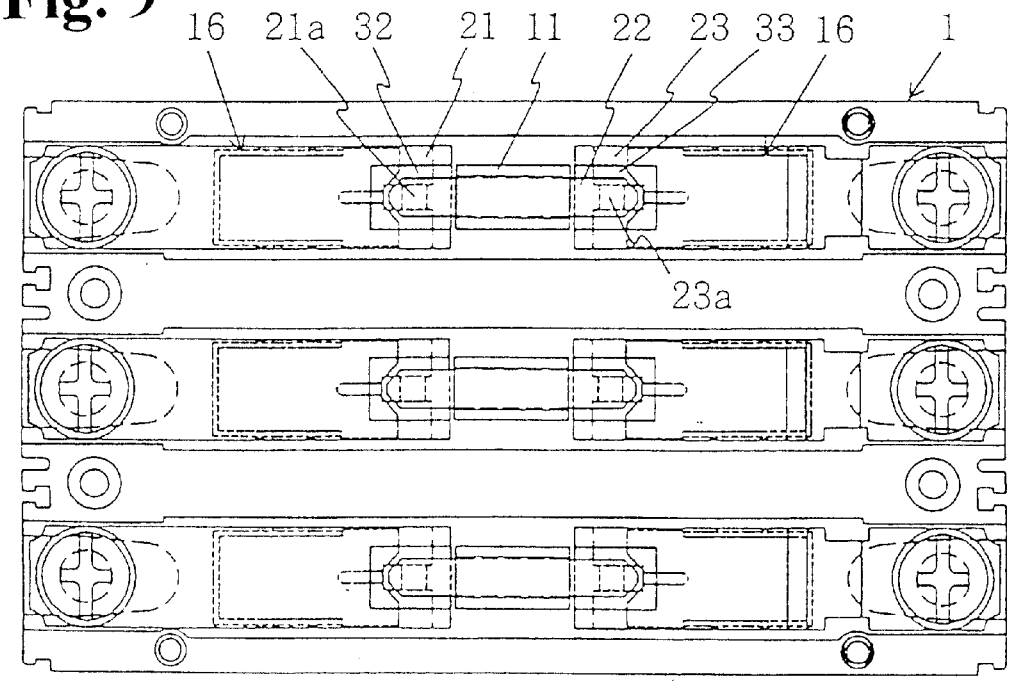
FIG. 9 is a plan view of the circuit breaker, wherein an intermediate case shown in FIG. 8 is removed.

FIG. 8 is a vertical sectional view of a different embodiment of a circuit breaker in which the holder holds the contact spring in addition to the movable contact shoe. FIG. 9 is a plan view in which the middle case shown in FIG. 8 is removed to reveal the case. In the circuit breaker shown in FIG. 6, the opening and closing mechanism 13 draws the holder 11 up from the case 1 toward the middle case 24 to effect contact pressure. In contrast, in the circuit breaker shown in FIG. 8, the holder 11 is pushed down from the middle case 24 toward the case 1 to provide a contact pressure.

In FIG. 8, a contact spring 26 is interposed between the movable contact shoe 22 accommodated in the window hole 11*a* in the holder 11, and a top surface of the window hole 11*a*. The fixed contact shoes 21 and 23 extend downward to the bottom surface of the case 1 and are then folded back in a U-shaped, and the fixed contacts 21*a* and 23*a* are attached to the top surfaces of the respective folded-back ends. In the ON state shown in FIG. 8, the switching lever 29 of the opening and closing mechanism 13 is placed at the illustrated position to slightly compress and deform the contact spring 26, so that it presses the movable contact shoe 22 against the fixed contact shoes 21 and 23 to thereby provide a predetermined contact pressure between the movable contacts 22*a* and the fixed contacts 21*a* and 23*a*.

As shown in FIGS. 8 and 9, the contact shoes 21 and 23 are notched over a distance equal to or larger than the width of the movable contact shoe 22 to form escape holes 32 and 33 at the portions of the fixed contact shoes 21 and 23 intersecting with the respective ends of the movable contact shoe 22. The respective ends of the movable contact shoe 22 are loosely inserted into the escape holes 32 and 33, respectively, so that they can move in the vertical direction inside the holes. As shown in FIG. 9, both sides of each of the folded-back ends of the fixed contact shoes 21 and 23 to which the fixed contacts 21*a* and 23*b* are attached, respectively, are removed, so that the width of the remaining portion of the folded-back end becomes equal to the width of the fixed contacts 21*a* or 23*a*.

For the circuit breaker shown in FIG. 8, when an overcurrent is generated, the switching lever 29 is rotationally driven counterclockwise to open the movable contact shoe 22. In this situation, the contact spring 26 moves integrally with the movable contact shoe 22 while being held by the holder 11, and is thus prevented from being compressed and deformed despite the opening of the movable contact shoe 22. As a result, a resistance from the contact spring 26 is precluded from acting on the opening and closing mechanism 13, and this reduction in road reduces the size of the opening and closing mechanism 13 and it can increase the opening speed of the movable contact shoe 22.

As described above, this invention can reliably protect the opening and closing mechanism accommodated in the middle case from an arc gas generated in the case, and can divide the middle case to improve working ability in assembly. In addition, the contact spring is held by the movable contact shoe holder to prevent the contact spring from effecting resistance upon the opening of the movable contact shoe, thereby reducing the load on the opening and closing mechanism and thus the size of this mechanism.

What is claimed is:

1. A circuit breaker comprising:

a box-shape insulated container including a lower case having a lower wall and a lower side wall extending from the lower wall to define an open top surface at a side opposite to the lower wall, a middle case having a bottom wall disposed on the lower side wall of the lower case and a through hole formed in the bottom wall, and a cover disposed on the middle case, an opening and closing mechanism disposed on the bottom wall of the middle case, a holder situated adjacent to and actuated by the opening and closing mechanism, said holder being made of an insulating material and disposed in the through hole of the bottom wall of the middle case to be slidable perpendicularly to the bottom wall, movable and fixed contact shoes accommodated in the lower case, said movable contact shoe having a projection in a middle thereof to extend in a direction opposite to the lower wall and a concave portion formed inside the projection, said movable contact shoe being attached to the holder to provide an open and close operation relative to the fixed contact shoe when the holder is moved, a contact spring situated in the concave of the movable contact shoe to urge the movable contact shoe toward the fixed contact shoe, and an arc-extinguishing chamber accommodated in the lower case and surrounding the movable contact shoe.

2. A circuit breaker according to claim 1, further comprising a power-supply-side terminal and a load-side terminal placed at longitudinal ends of the middle case of the insulated container spaced apart from each other, a conductor disposed in the insulated container to form an electric path between the terminals, said fixed and movable contact shoes being situated in the electric path, and an overcurrent trip device for tripping the opening and closing mechanism and accommodated in the middle case.

3. A circuit breaker according to claim 2, wherein said middle case has a power supply side and a load side, said opening and closing mechanism being accommodated in the power supply side and the overcurrent trip device is accommodated in the load side.

4. A circuit breaker according to claim 3, wherein said load side of the middle case is divided so as to correspond to each polarity.

5. A circuit breaker according to claim 1, wherein said contact spring applies a contact pressure between a movable contact of the movable contact shoe and a fixed contact of the fixed contact shoe.

6. A circuit breaker according to claim 5, wherein said opening and closing mechanism draws said holder up from the case toward the middle case to effect the contact pressure.

7. A circuit breaker according to claim 5, wherein said opening and closing mechanism pushes said holder down from the middle case toward the case to effect the contact pressure.

8. A circuit breaker according to claim 5, wherein said holder includes a hole therein, in which the projection of the movable contact shoe and the contact spring are located to allow the contact spring to move together with the holder so that when the holder is moved upwardly to contact the movable contact with the fixed contact, the contact spring provides additional pressure to effectively contact the movable contact to the fixed contact.

9. A circuit breaker according to claim 1, wherein said middle case further including a middle side wall extending upwardly from the bottom wall, and said cover includes a top wall and a cover side wall extending downwardly from the top wall to define an open bottom.

10. A circuit breaker according to claim 1, wherein said contact spring is disposed on the lower wall of the lower case.

* * * * *